US006427271B1

(12) United States Patent
Gadzia et al.

(10) Patent No.: US 6,427,271 B1
(45) Date of Patent: Aug. 6, 2002

(54) RESCUE APPARATUS AND METHOD OF USE

(75) Inventors: Sandra Lee Gadzia; Richard Alfred Gadzia, both of Butler, PA (US)

(73) Assignees: Sandra Lee; Richard Gadzia, both of Butler, PA (US)

( * ) Notice: Subject to any disclaimer, the term of this patent is extended or adjusted under 35 U.S.C. 154(b) by 0 days.

(21) Appl. No.: 09/503,827

(22) Filed: Feb. 15, 2000

(51) Int. Cl.[7] ..... A61G 1/013; B66C 1/12

(52) U.S. Cl. ..... 5/627; 5/625; 294/77

(58) Field of Search ..... 5/627, 625, 88.1, 5/655; 119/728, 725; 294/77, 66.1, 140, 152

(56) References Cited

U.S. PATENT DOCUMENTS

| | | | | | |
|---|---|---|---|---|---|
| 119,765 | A | * | 10/1871 | Hohorst | 294/77 |
| 355,361 | A | * | 1/1887 | Walsh | 294/77 |
| 363,113 | A | * | 5/1887 | Burrell et al. | 294/77 |
| 471,861 | A | * | 3/1892 | Hohorst | 294/77 |
| 926,242 | A | * | 6/1909 | Clark | 294/77 X |
| 1,365,511 | A | * | 1/1921 | Lee | 294/77 |
| 1,781,458 | A | * | 11/1930 | Gore | 294/77 X |
| 1,827,447 | A | * | 10/1931 | Wilmore | 294/77 |
| 2,123,268 | A | * | 7/1938 | Young | 182/139 |
| 2,385,067 | A | * | 9/1945 | Egardner | 5/627 |
| 2,440,712 | A | * | 5/1948 | Bickell | 294/77 |
| 2,809,860 | A | * | 10/1957 | Arnold | 294/77 |
| 2,813,745 | A | * | 11/1957 | Frieder et al. | 294/77 |
| 2,925,141 | A | * | 2/1960 | Frieder et al. | 294/77 X |
| 3,011,820 | A | * | 12/1961 | Frieder et al. | 294/77 |
| 3,084,966 | A | * | 4/1963 | Higgins | 294/77 |
| 3,292,831 | A | * | 12/1966 | Moen | 294/77 X |
| 3,383,721 | A | * | 5/1968 | Adams, Jr. | 294/661 X |
| 3,552,613 | A | * | 1/1971 | Nye | 294/77 X |
| 3,775,782 | A | | 12/1973 | Rice et al. | |
| 3,813,712 | A | | 6/1974 | Bonnin | |
| 3,870,256 | A | * | 3/1975 | Mazzella et al. | 294/77 X |
| 4,159,840 | A | * | 7/1979 | Fengels | 294/77 |
| 4,621,382 | A | | 11/1986 | Burriss et al. | |
| 4,664,266 | A | * | 5/1987 | Fausett et al. | 211/87.01 |
| RE33,232 | E | * | 6/1990 | Fausett et al. | 211/87.01 |
| 5,243,639 | A | | 9/1993 | Johnson | |
| 5,442,821 | A | * | 8/1995 | Weeks | 5/627 X |
| 5,499,416 | A | | 3/1996 | Daouk | |
| 5,502,854 | A | | 4/1996 | Daouk | |
| 5,598,592 | A | * | 2/1997 | Castellani | 5/627 |
| 5,699,571 | A | * | 12/1997 | Yowell | 5/655 X |
| 5,720,303 | A | * | 2/1998 | Richardson | 5/625 X |
| 5,978,989 | A | * | 11/1999 | Chavez | 5/627 |
| 6,276,383 | B1 | * | 8/2001 | Galstad | 135/120.1 |

FOREIGN PATENT DOCUMENTS

| | | | | |
|---|---|---|---|---|
| CA | 593871 | * | 3/1960 | 294/77 |
| DE | 868658 | * | 2/1953 | 294/77 |
| DE | 199309 | * | 8/1958 | 5/627 |
| DE | 2644044 | * | 4/1978 | 294/77 |
| FR | 607235 | * | 6/1926 | 294/77 |
| FR | 697189 | * | 1/1931 | 294/77 |
| FR | 2271805 | * | 12/1975 | 5/625 |
| GB | 722007 | * | 1/1955 | 294/77 |
| GB | 800165 | * | 8/1958 | 294/77 |
| GB | 842128 | * | 7/1960 | 294/77 |
| NL | 68327 | * | 2/1951 | 294/77 |

OTHER PUBLICATIONS

Advertisement for "MAN–S.A.C. (Single Access Carrier)", Maxim Technologies Inc., Mar. 29, 1996.*

* cited by examiner

*Primary Examiner*—Robert G. Santos

(57) ABSTRACT

A rescue apparatus includes at least one flexible support member and a plurality of handles and an attachment member extending outwardly therefrom. The support member includes a mesh portion formed with a plurality of openings that together form a open area that constitutes a major portion of the support area of the support member. The rescue apparatus is flexible, foldable, and collapsible, and may be stored during periods of non-use in a flexible container. The rescue apparatus is used by positioning it underneath a person such that the rescue apparatus underlies and at least partially wraps around the person being rescued. The handles are then lifted, allowing water or debris to drain or fall away from the person being rescued to reduce the lifting effort required.

16 Claims, 3 Drawing Sheets

RESCUE APPARATUS AND METHOD OF USE

BACKGROUND OF THE INVENTION

1. Field of the Invention

The present invention relates generally to a rescue device and, more particularly, to a rescue device for use in removing a person from a body of water or other potentially hazardous condition and to methods of using the same. More specifically, the invention relates to a flexible rescue device that is structured to be wrapped around the person and that is formed with a plurality of openings.

2. Description of the Prior Art

Numerous devices are known for rescuing persons from hazardous conditions such as bodies of water, mountaintops, and the like. Such rescue devices often are in the form of substantially rigid stretchers or relatively flexible members mounted on substantially rigid frames. While such devices are generally useful for their intended purposes, such devices are not without limitation.

The rescue of a person from, for example, a roadside or a building often can be accomplished with a stretcher-type device. The person is laid on the upper surface of the stretcher, is typically secured thereon by a belt or other restraint, and the stretcher is carried away to a safe destination or place of medical care. The rescue of a person from a hazardous condition such as a body of water or a mountaintop is substantially more difficult. Typically, the individual would be at a lower level than an adjacent boat, dock, or other destination.

For example, in rescuing a person from a body of water, the rescue device should preferably be positioned to underlie the person being rescued. Other persons disposed at a safety destination such as a dock or on an adjacent boat must lift the rescue device upward to remove the person from the water. Such removal can be extremely difficult due to the difficulty in positioning a rigid member underneath a person disposed in the water as well as the difficulty in lifting the person, the stretcher, and a substantial quantity of water that typically is retained by the rescue device. Also, the pitching and rolling of a boat makes lifting of a rescue device extremely difficult. Moreover, previously known rescue devices usually include one or more substantially rigid frame members and as a result occupy a considerable amount of space when not in use. Inasmuch as space aboard a boat is often severely limited, a rigid rescue device is particularly impractical.

There remains, therefore, a need for a rescue device that facilitates safe and easy removal of a person from a hazardous condition and that can be configured to be stored in a small storage space.

SUMMARY OF THE INVENTION

A rescue apparatus includes a flexible support member and a plurality of handles peripherally extending therefrom. The flexible support member includes a mesh member and a peripheral border with the handles extending outwardly from the border. The support member is configured to underlie and be at least partially wrapped around a person being rescued. The member is preferably formed with a plurality of openings that allow water to flow through the rescue apparatus while the person is being lifted from the body of water. A mesh structure is the preferred construction. The person is removed from the body of water by lifting upwardly on the handles to pull the person from the hazardous condition.

Another aspect of the present invention is to provide a method of rescuing a person from a hazardous condition, the general nature of which may be stated as including the steps of wrapping a flexible support member beneath and at least partially around the person, followed by lifting the support member to remove the person and the support member from the hazardous condition.

The support member has a support area and is formed with a plurality of openings with the openings preferably being at least 70% of the support area, Another aspect of the present invention is to provide a rescue apparatus for rescuing a person. The apparatus may include a flexible support member having a support area, the support member being formed with a plurality of openings, the support member being structured to underlie and at least partially wrap around a person, a plurality of handles mounted on the support member, and the openings forming an open area with the open area preferably being at least 70% of the support area.

A further aspect of the invention is to provide the combination of a rescue apparatus and a flexible container. The rescue apparatus includes a flexible support member and a plurality of handles secured thereto, the support member being formed with a plurality of openings, the support member being free of substantially rigid structural members, and the container being sized to accommodate the rescue apparatus when folded.

It is an object of the present invention to provide a lightweight, open, flexible rescue apparatus for removing a person from a hazardous or undesirable situation and the method of using the same.

It is another object of the present invention to provide such an apparatus which is flexible and storable in a folded condition in a relatively small space.

It is a further object of the present invention to provide such a system which may be employed advantageously in water rescue.

It is a further object of the present invention to provide such a system in which the apparatus is durable and economical.

It is a further object of the present invention to provide such an apparatus and method which is easy to use.

These and other objects of the present invention will be more readily understood from the following description in reference to the drawings.

BRIEF DESCRIPTION OF THE DRAWINGS

Similar numerals refer to similar parts throughout the specification.

DESCRIPTION OF THE PREFERRED EMBODIMENTS

The terms "rescue" and "rescuing" refer to the removal of a person from a potentially hazardous condition, whether the person is in danger, such as when the person is ill, injured or disabled, or whether the person is in a potentially hazardous situation from which it is desirable to remove the person.

The term "hazardous condition" refers to any condition or situation that may potentially be injurious or fatal to a person, whether or not the person is injured, such as a body of water or a rugged environment. Bodies of water may include lakes, open water, rivers, swimming pools, spas, as well as other water-related conditions. Rugged environments include mountainous regions, tower structures, and construction sites, as well as other environments.

The term "mesh" refers to one or more mutually interconnected or interwoven elements to form a body having a support area formed with a large number of openings. The openings are a substantial portion of the support area of the rescue apparatus, the mesh being generally flexible, foldable, and collapsible. The support area provides support for the person and is secured to the rest of the support member as a separate member or permanently attached thereto.

Figure 1:
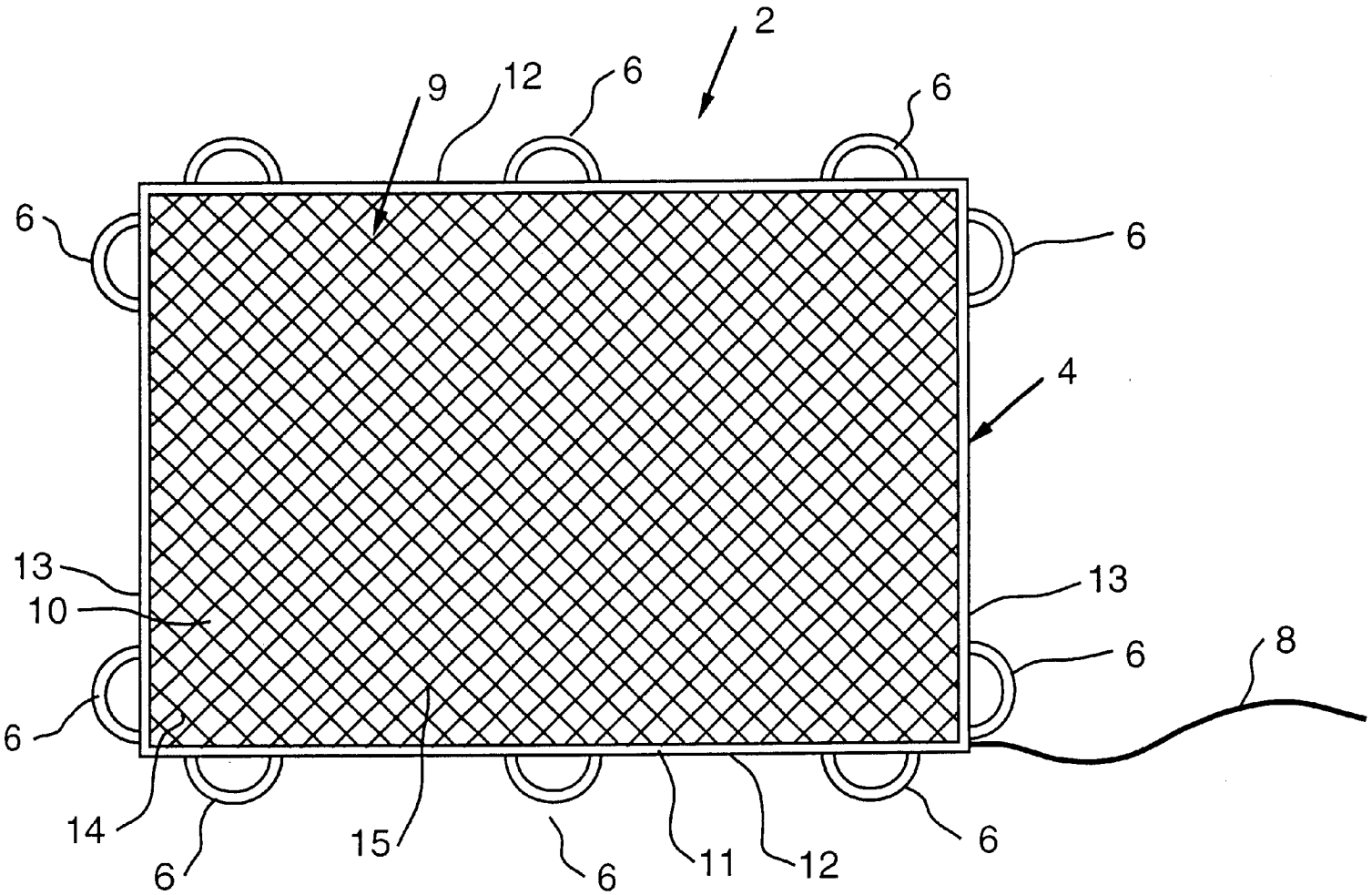
FIG. 1 is a top plan view of a rescue apparatus in accordance with the present invention.
Figure 2:
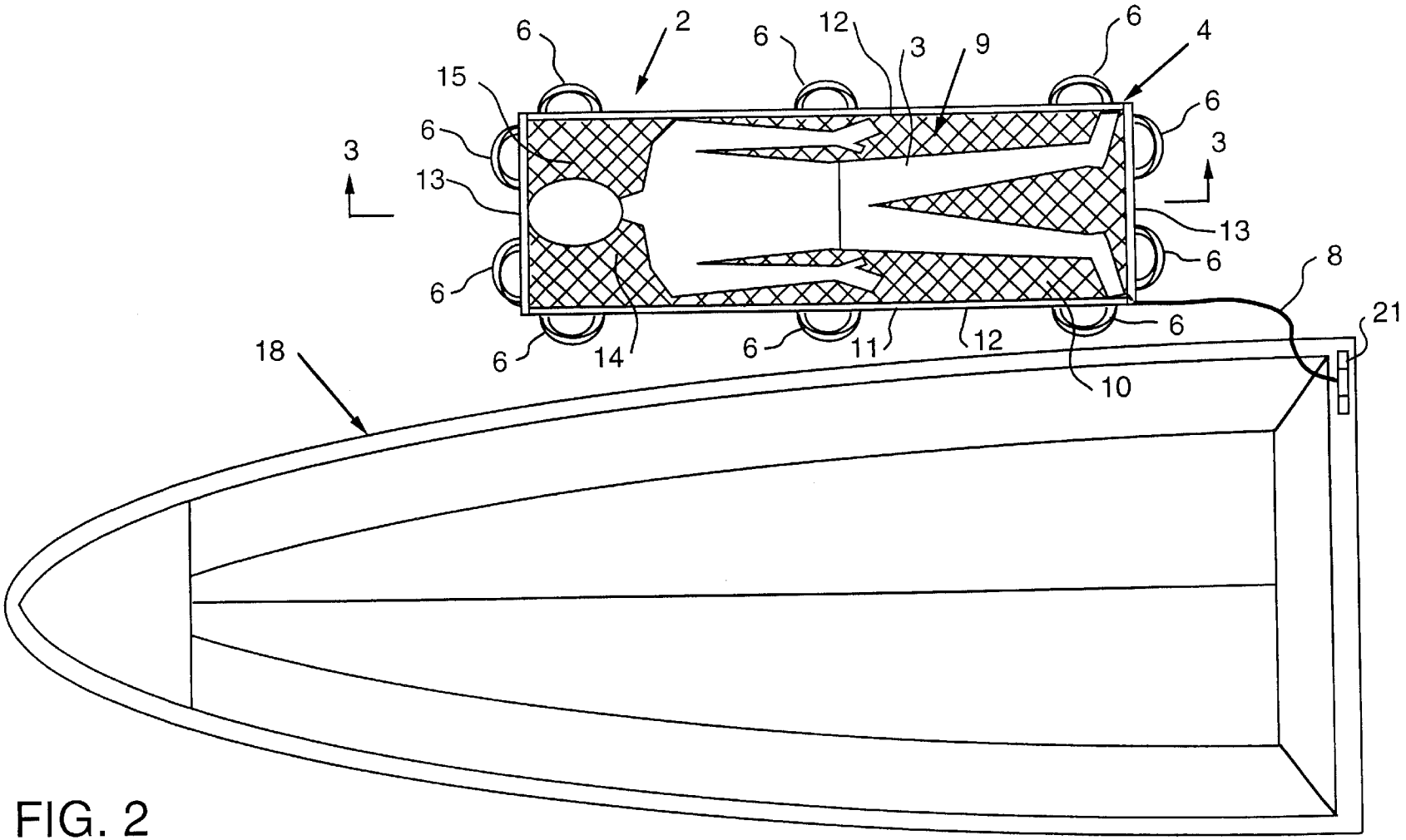
FIG. 2 is a plan view showing the rescue apparatus of the present invention being employed to remove a person from a body of water into a boat.
Figure 3:
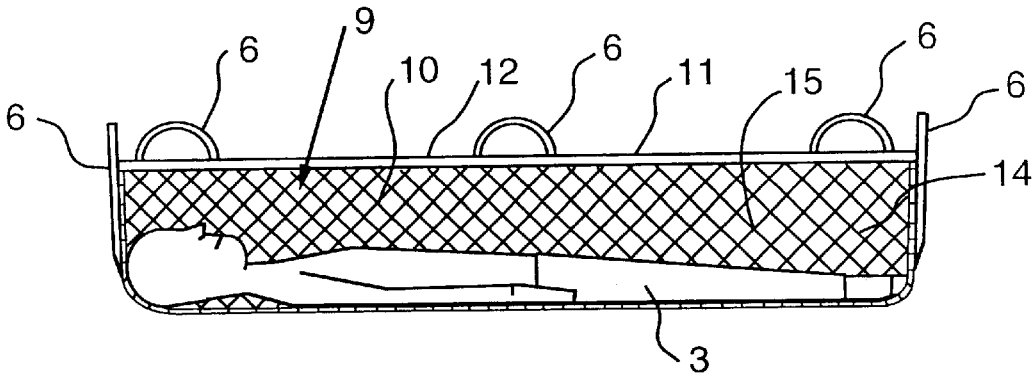
FIG. 3 is a sectional view as taken along line 3—3 of FIG. 2.

A rescue apparatus 2 in accordance with the present invention is illustrated generally in FIGS. 1–3. The rescue apparatus 2 is a generally flexible member that can underlie and at least partially wrap around a person 3 who is being rescued from a hazardous condition, such as a body of water. While any of a wide variety of materials may be employed to manufacture the rescue apparatus 2, it is preferred that such material be highly resistant to water absorption and mildew, resistance to UV degradation, as well as strong, lightweight, and flexible, such as a high tensile strength polypropylene or nylon, for example, although any of a wide variety of materials may be used without departing from the spirit of the present invention.

The rescue apparatus 2 includes a flexible support member 4, a plurality of handles 6 mounted on the support member 4. A flexible attachment member 8 is secured to the support member as a separate member or integrally attached thereto, and extends outwardly from the support member 4. The support member 4 is a generally flexible, lightweight, strong member that includes a flexible mesh support area 9 formed with a plurality of openings 10 and a flexible border 11 peripherally secured to support area 9. The support member 4, in the form shown, is of a generally rectangular shape and includes a pair of substantially parallel and spaced apart sides 12 and a pair of substantially parallel and spaced apart ends 13 that together define a border 11 for the support area 9.

The sides 12 are of a length that is preferably about 5 to 7 feet, and the ends 13 are of a length that is preferably about 4 to 6 feet. It is understood, of course, that the sides 12 and the ends 13 can be of lengths smaller and greater than that set forth hereinbefore depending upon the specific need of the particular application without departing from the spirit of the present invention.

The openings 10 formed in the mesh support area 9 together provide open areas through which water and/or debris may drain or fall away from the person 3 during rescue or removal from a hazardous condition. The openings in support area 9 are preferably a major portion of the support area 9 of the support member 4, and are preferably at least 70% of the support area 9. The configuration of the mesh member 9 in which the openings 10 constitute such a substantial portion of the support area of the support that gives the mesh member 9 has a mesh-like or net-like character. It is understood, however, that numerous other configurations for support area 9 are possible without departing from the spirit of the present invention, such as configurations in which the open area defined by the openings 10 is a smaller portion of the support area.

The mesh member 9 is constructed out of a plurality of mutually elongated strands 14 that interconnect with one another at a plurality of junctions 15. The elements 14 may be constructed in any of the variety of fashions and may be of monofilament, stranded, woven, or other appropriate configurations. The junctions 15 may be formed in numerous appropriate fashions such as by weaving, tying, or forming the elements 14 into mutual interconnection with one another. It is also understood, however, that the junctions 15 may be formed in other appropriate fashions depending upon the specific manner in which the mesh member 9 is structured and the material out of which it is manufactured.

The border 11 is a flexible member which is peripherally attached to the support or mesh member 9. The border 11 helps to reinforce and maintain the desired configuration of the mesh member 9 such as rectangular, square or oval, for example. It also causes forces applied to a given region of the mesh member 9 to be at least partially distributed to other regions of the mesh member 9 to reduce the likelihood of tearing, breakage, or other failure of the mesh member 9. The border 11 is preferably manufactured out of a natural or synthetic fabric material and is fixedly attached to the mesh member 9 by sewing or other appropriate attachment method. The border 11 and the mesh member 9 are preferably manufactured out of the same material or out of materials having similar characteristics for strength and resistance to water absorption, resistance to UV degradation and mildew, although different types of materials may be used without departing from the spirit of the present invention. The border 11 may alternatively be attached to the mesh member 9 by other appropriate methods or may be formed integrally therewith as a single unit without departing from the spirit of the present invention.

An additional feature of the border 11 is that it serves as an attachment area for the handles 6. The handles 6 are preferably in the form of loops or are looplike and are attached at the ends thereof to the border 11. The handles 6 may be manufactured out of the same material as the border 11 or may be of a different material without affecting the concept of the present invention. The handles 6 are preferably flexible to contribute to the overall flexibility of the rescue apparatus 2, although the handles 6 may additionally contain rigid or semi-rigid members to assist in the use thereof.

It is also understood that the handles 6 may be attached directly to the mesh member 9 without departing from the spirit of the present invention. In this regard, alternate configurations of the support member 4 might not include the border 11 without affecting the function of the rescue apparatus 2.

As is best shown in FIG. 1, the border 11 extends peripherally along the mesh member 9 along the sides 12 and ends 13. The handles 6 are preferably configured such that three handles 6 are disposed on each side 12, evenly spaced thereon, and two handles 6 are mounted on each end 13, evenly spaced thereon. Different numbers of handles 6 and different arrangements thereof on the support member 4 are possible depending on the specific needs of the particular application without departing from the concept of the present invention. In this regard, alternate configurations of the support member 4 may exist in which the border 11 extends only along the sides 12 and/or ends 13 along which the handles 6 are mounted. Again, such alternate configurations are intended to meet the specific needs of particular applications and do not depart from the spirit of the present invention.

The attachment member 8 may be a substantially flexible line that extends outwardly from the border 11 for attachment onto another structure to prevent the rescue apparatus 2 from being lost during use and for other purposes. The attachment member 8 may be of any of a variety of appropriate configurations such as a monofilament, woven, knit, or stranded configurations, or other appropriate configurations depending on the specific needs of the particular application. Still alternatively, the attachment member 8 may be integrally formed as a single unit with the border 11 and/or the mesh member 9. Also, the attachment member 8 may extend outwardly from one of the handles 6 without departing from the spirit of the present invention. It is preferred that each cord element of the mesh member 9 have a tensile strength of at least 120 lbs. and preferably greater than 250 lbs.

Figure 4:
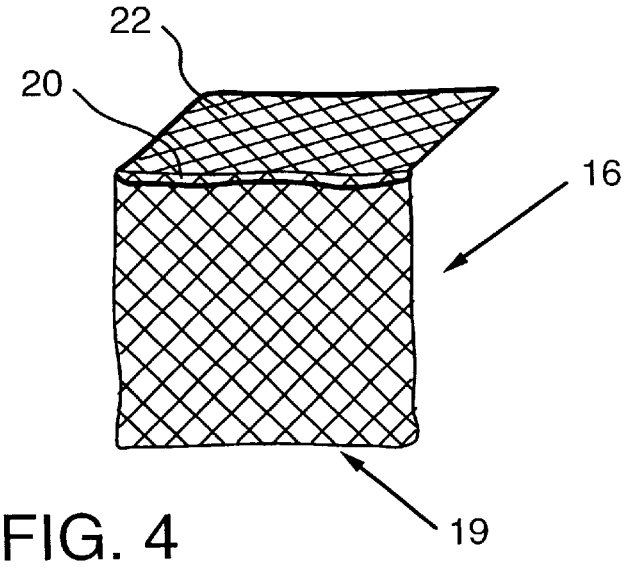
FIG. 4 is schematic view of a container in accordance with the present invention that receives the rescue apparatus of the present invention for storage.

The rescue apparatus 2 is preferably stored or retained in a container 16 during periods of non-use. The container 16 is best depicted in FIG. 4. The container 16 is flexible and preferably is manufactured out of a material that is the same as or similar to the material used to manufacture the mesh member 9. In this regard, the container 16 preferably is of a mesh-like configuration similar to that of the mesh member 9, although the container 16 may be manufactured out of other materials without departing from the spirit of the present invention. As such, the container 16 preferably is flexible, lightweight, strong, and is resistant to UV degradation, water absorption and mildew. It permits air flow therethrough. The generally flexible nature of the rescue apparatus 2 permits the rescue apparatus 2 to be folded, compressed, collapsed, or otherwise reduced in overall size and placed into the container 16 for storage or retention during periods of non-use. The additional flexible nature of the container 16 with the rescue apparatus 2 therein permits the container 16 with the rescue apparatus 2 to be placed in extremely small and/or awkward spaces that might otherwise be unused. The container 16 in the form shown, has a rescue apparatus receiving pouch 19 with opening 20 and closure flap 22. A latching means, such as a flexible tie, string or loop, or easy to open securing device may be provided.

The fact that the rescue apparatus 2 and the container 16 can be stored in awkward spaces is particularly useful when the rescue apparatus 2 is carried aboard a boat 18. Watercraft typically include very limited space thereon, with such spaces often being awkward or of a non-parallelepiped configuration based upon the shape of the hull, the need for structural support of the hull, and the general requirements of seaworthiness. The flexibility of the rescue apparatus 2 and the container 16 enhances the likelihood that the rescue apparatus 2 will remain on board the boat 18 (FIG. 2) inasmuch as the rescue apparatus 2 and the container 16 can be stored in non-critical regions of the boat 18 or in regions thereof that ordinarily could not be used for the storage of other gear that might typically be carried aboard the boat 18.

As indicated hereinbefore, the rescue apparatus 2 is stored or retained in the container 16 during periods of non-use, and the container 16 is then carried aboard the boat 18 or is stored in other areas where rescue or removal of the person 3 from a hazardous condition may be desirable or required. The rescue apparatus 2 is used by removing it from the container 16, unfolding or otherwise expanding the rescue apparatus 2 by unfolding or pulling, and attaching by tying or otherwise fastening the attachment member 8 onto a substantially stationary structure such as, for example, a cleat 21 (FIG. 2) formed on the boat 18 or a pillar of a pier. The rescue apparatus 2 is then moved underneath the person 3 such that the support member 4 preferably underlies and at least partially wraps or extends around the person 3. The generally flexible nature of the rescue apparatus 2 advantageously permits it to be easily handled under water or in adverse condition such as on a mountaintop. The flexible nature further forms itself to the contour of the person 3 and additionally permits the support member 4 to be substantially positioned around the person 3 while minimizing the movement of injured parts of the person 3, such as the limbs.

Once the support member 4 is in proper position, the handles 6 are lifted generally upwardly to lift the person 3 and the support member 4 from the hazardous condition. When the person 3 is being removed from a body of water, the water is permitted to drain through the openings 10 at an extremely rapid rate such that the lifting effort required to remove the person 3 from the body of water involves lifting substantially only the person 3 and very little of the water. It can be seen, therefore, that the water has been substantially drained away from the person 3 at the moment the person 3 has been removed from the body of water. In the event that the hazardous condition is on solid ground, the openings 10 permits soil, rocks, and other foreign debris that might be painful to the person to fall away and not interfere with the rescue effort.

In removing the person 3 from a body of water, the lifting effort is often applied to the handles 6 by other persons disposed at a safety destination such as inside a boat, atop a pier, or at other appropriate locations. In this regard, it may be necessary to first bring the person 3 being rescued alongside the safety destination with appropriate equipment. This is particularly desirable when the hazardous condition is a body of water and the safety destination is inside the boat 18. In this regard, it is understood that the lifting effort applied to the handles 6 may be provided by mechanical structures such as cables having hooks that are lifted by a windlass or winch or helicopter, or other appropriate system instead of by other persons. It is also understood that whatever material is employed to manufacture the rescue apparatus 2, that the material is non-injurious to the person 3 and preferably also non-irritating.

The rescue apparatus 2 is conveniently and reliably stored aboard the boat 18 or in other locations due to its compact size and its qualities of flexibility and resistance to water absorption and mildew propagation. During use, the rescue apparatus 2 is conveniently removed from the container 16, attached by the attachment member 8 to a relatively stationary structure and is readily positioned around the person being rescued. The support member 4 is then lifted by the handles 6, thereby swiftly and easily removing the person 3 from the hazardous condition inasmuch as the person is enveloped or retained in the support member 4 and inasmuch as the water or debris would be drained or would fall away through the openings 10. The rescue apparatus 2 advantageously permits the quick and safe withdrawal of the person 3 from the hazardous condition and permits the person 3 to be quickly transferred to a hospital or other appropriate location as needed.

If desired, reinforcing means, such as grommets, may be provided on the support member 4 for securement of attachment member 8. Ropes, lines or cables having hooks, snap fasteners or other engaging means may be secured to the grommets for assisting with retention of support member 4 or, if a plurality of attachment members 8 are used, assistance with lifting the person containing support member 4. The grommets may be provided, for example, in border 11.

EXAMPLE

In order to provide further details of the invention, an example will be considered. A rescue apparatus 2 is generally rectangular and has an outer dimension of about 5 feet by 6 feet. The support area mesh is made of high tensile strength (at least 120 lb.) polypropylene of about 1.5 mm diameter. The material is resistant to ultraviolet radiation degradation and stretching. The mesh opening is about 1 inch by 1 inch. The rescue apparatus when stored folds to about 10 inches by 10 inches by 4 inches. The container 16 may be a mesh bag that has a depth of about 13 inches and a width of about 11 inches.

It will be appreciated that the present invention provides a simple, effective, easily stored apparatus and associated method for rescuing people from hazardous conditions. This is accomplished without requiring the people conducting the rescue to be specially trained or to have the burden of lifting large quantities of water, rock or debris along with the person being rescued.

While particular embodiments of the present invention have been described herein, it is understood that various changes, additions, modifications, and adaptations may be made without departing from the scope of the present invention, as is set forth in the following claims.

What is claimed is:

1. A rescue apparatus for rescuing a person from a hazardous condition, the rescue apparatus comprising:

a flexible rescue support member formed from a material which is highly resistant to water absorption, mildew, ultraviolet radiation degradation, and stretching, and having a support area, the support member being formed from a plurality of interconnected elongated strands each having a tensile strength of at least 120 lbs. and preferably greater than 250 lbs. with a plurality of openings therebetween, the support member being structured to underlie and at least partially wrap around the person being rescued;

a plurality of handles mounted on the support member structured for engagement to provide a lifting force to said support area during removal of said person from said hazardous condition, and the openings forming an open area, which is at least 70% of the support area.

2. The rescue apparatus of claim 1, including a peripheral flexible border.

3. The rescue apparatus of claim 2, in which the handles are mounted on the border and are structured to be engaged when a lifting force is applied to said rescue apparatus to move said person from a first position to a second position.

4. The rescue apparatus of claim 1, in which the support member is generally rectangular in shape.

5. The rescue apparatus of claim 4, in which the support member has a length in approximately the range of 5 to 7 feet and a width approximately in the range of 4 to 6 feet.

6. The rescue apparatus of claim 4, in which the support member includes a pair of sides and a pair of ends, the handles being disposed on at least three of the pair of sides and the pair of ends.

7. The rescue apparatus of claim 1, in which the handles are at least partially flexible.

8. The rescue apparatus of claim 7, in which the handles are in the form of loops.

9. The rescue apparatus of claim 1, further comprising at least one flexible attachment member secured to the support member.

10. The rescue apparatus of claim 9, further comprising a flexible border peripherally disposed on the support member, the attachment member being mounted on the border.

11. The rescue apparatus of claim 1, in which the support member is free of substantially rigid structural members.

12. The rescue apparatus of claim 1, in which the support member is mesh.

13. The rescue apparatus of claim 9 including said support member having a plurality of grommets, and a said flexible attachment member for each said grommet.

14. Rescue apparatus comprising:

a rescue apparatus, the rescue apparatus including a flexible support member formed from a material which is highly resistant to water absorption, mildew, ultraviolet radiation degradation, and stretching and including a plurality of handles, the support member being formed from a plurality of interconnected elongated strands each having a tensile strength of at least 120 lbs. and preferably greater than 250 lbs. with a plurality of openings therebetween, the handles being mounted on the support member, the support member being free of substantially rigid structural members;

said handles being structured for engagement to provide a lifting force to said support area during removal of said person from said hazardous condition, and a flexible container being sized to accommodate the rescue apparatus without requiring assembly thereof.

15. The combination of claim 14, in which the container is resistant to water absorption.

16. The combination of claim 14, in which the container is at least partially mesh.

* * * * *